US005913632A

United States Patent [19]

Persad

[11] Patent Number: 5,913,632

[45] Date of Patent: Jun. 22, 1999

[54] REFILLABLE DENTRIFICE DISPENSING TOOTHBRUSH

[76] Inventor: Suresh L. Persad, 2881 Third Ave. SW., Atlanta, Ga. 30315

[21] Appl. No.: 09/042,703

[22] Filed: Mar. 17, 1998

Related U.S. Application Data

[63] Continuation-in-part of application No. 08/979,840, Nov. 26, 1997

[60] Provisional application No. 08/753,748, Nov. 29, 1996.

[51] Int. Cl.[6] ..... B43K 5/06

[52] U.S. Cl. ..... 401/175; 401/171; 401/172; 401/176; 401/182

[58] Field of Search ..... 222/387, 388; 401/171, 172, 175, 176, 182

[56] References Cited

U.S. PATENT DOCUMENTS 3,995,648 12/1976 Kuryla ..... 401/175
4,421,433 12/1983 Villanueva ..... 401/175

*Primary Examiner*—Robert M. Fetsuga
*Assistant Examiner*—Tuan N. Nguyen
*Attorney, Agent, or Firm*—Womble Carlyle Sandridge & Rice

[57] ABSTRACT

A toothbrush unit allows for storage of a dentifrice within a cavity defined within a toothbrush body. The stored dentifrice is dispensed onto the bristles of the toothbrush head by actuating a bushing drive unit that is also disposed within the body cavity. The bushing drive unit of the toothbrush allows for two-way movement of a compression piston axially along a threaded drivescrew. Upon movement of the piston toward the bristlehead of the toothbrush, in which a plurality of openings are provided, the dentifrice is forced through the cavity, through the bristlehead openings, and onto the bristles. As the supply of the dentifrice is depleted, or at any time refilling is necessary, the piston is moved toward the posterior end of the toothbrush to allow for injection of additional dentifrice into the body cavity. The dentifrice is injected from an ordinary tube of dentifrice and into the cavity through an opening in the posterior end of the toothbrush, the opening having internal threads which mate with the standard external threading on the front tip of the dentifrice tube. A pressure relief orifice is formed into the toothbrush body to fluidly communicate with the body cavity, thereby permitting the release of air pressure during the refilling process.

3 Claims, 2 Drawing Sheets

REFILLABLE DENTRIFICE DISPENSING TOOTHBRUSH

CROSS REFERENCE TO RELATED APPLICATION

This application is a Continuation-In-Part of application Ser. No. 08/979,840 filed Nov. 26, 1997, which claims the benefit of provisional application Ser. No. 08/753,748 filed Nov. 29, 1996, now abandoned.

TECHNICAL FIELD

This invention relates to a toothbrush that has the capacity to store a generous amount of glycerin based toothpaste to be dispensed directly to the top of the bristles for application by means of a thumbscrew piston drivescrew assembly that compresses the toothpaste and dispenses the toothpaste through two soft snap nipple openings in the bristlehead directly to the bristles.

BACKGROUND OF THE INVENTION

Previous attempts have been made to provide a toothbrush with an integral supply of toothpaste that can be dispensed to the bristle area by means of compressing the toothpaste by mechanical devices located internally in the unit.

There are three main categories of this type product:

1. Toothbrushes that are totally disposable after the factory filled toothpaste is totally disposed of as illustrated in U.S. Pat. No. 4,521,128.
2. Disposable cartridge type toothbrushes where the cartridge is the supply of toothpaste and is discarded after the supply is depleted and the supply is replenished by a replacement of a new factory filled cartridge as illustrated in U.S. Pat. No. 4,332,497 and U.S. Pat. No. 5,066,155.
3. Refillable toothbrushes that can be filled by the user with a toothpaste of his choice from a standard tube of toothpaste as is illustrated in U.S. Pat. Nos. 4,201,490 and 3,728,035.

The prior art toothbrushes of the dispenser type have included a variety of means for carrying the toothpaste and dispensing the toothpaste in varying amounts. Such prior art devices have had certain disadvantages which include clogging of the passageways leading to the dispensing openings which allows the toothpaste to become stiff and stale, lack of a sanitary sealable refiner device resulting in toothpaste leakage, and the user required to handle components coated in toothpaste. Toothbrushes that are not designed with sufficient capacity to supply a convenient amount of toothpaste to satisfy consumer requirements, and toothbrushes of a design not readily acceptable to the general public. Examples of prior art apparatuses and devices which are known to the applicant are U.S. Pat. Nos. 4,201,490; 3,728,035; 3,256,894; 3,826,580; 4,039,261; 2,081,792; 3,228,057; and 2,750,614.

In the opinion of the applicant, the above-identified United States patents represent the closest prior art of which the applicant is aware.

SUMMARY OF THE INVENTION

The present invention which will be described subsequently in greater detail comprises a toothbrush of exterior design compatible with consumer accepted and commercially marketed designs that within contains a hollow cavity from end portion to end portion of a capacity sufficient to encompass an amount of toothpaste to allow a user to dispense 21 to 24 applications of toothpaste directly to a plurality of bristles attached to the bristlehead by means of a thumbscrew activator, piston, and drivescrew assembly through two soft snap nipple orifices.

The present invention has a capacity to be refilled at the posterior end of the unit by means of screwing into the interior threaded end of the refiner device any standard tube of toothpaste and applying pressure to the tube in a normal way.

The refiller device is so designed as to prohibit backflow of toothpaste during the refilling application and to seal by means of a hinged airtight cap seal to prevent contamination.

The invention is so designed as to maintain a hygienically sealed product that when filled and refilled with a glycerin based toothpaste, the toothpaste will maintain a fluidity over an extended period of time.

It is therefore the object of the present invention to provide a new and improved toothbrush having an integral toothpaste dispenser.

It is a further object of the present invention to provide a toothbrush of simplicity of design, assembly, and manufacture from plastics, polymers, and elastomers of Food Grade quality.

DESCRIPTION OF THE PREFERRED EMBODIMENT

Figure 1:
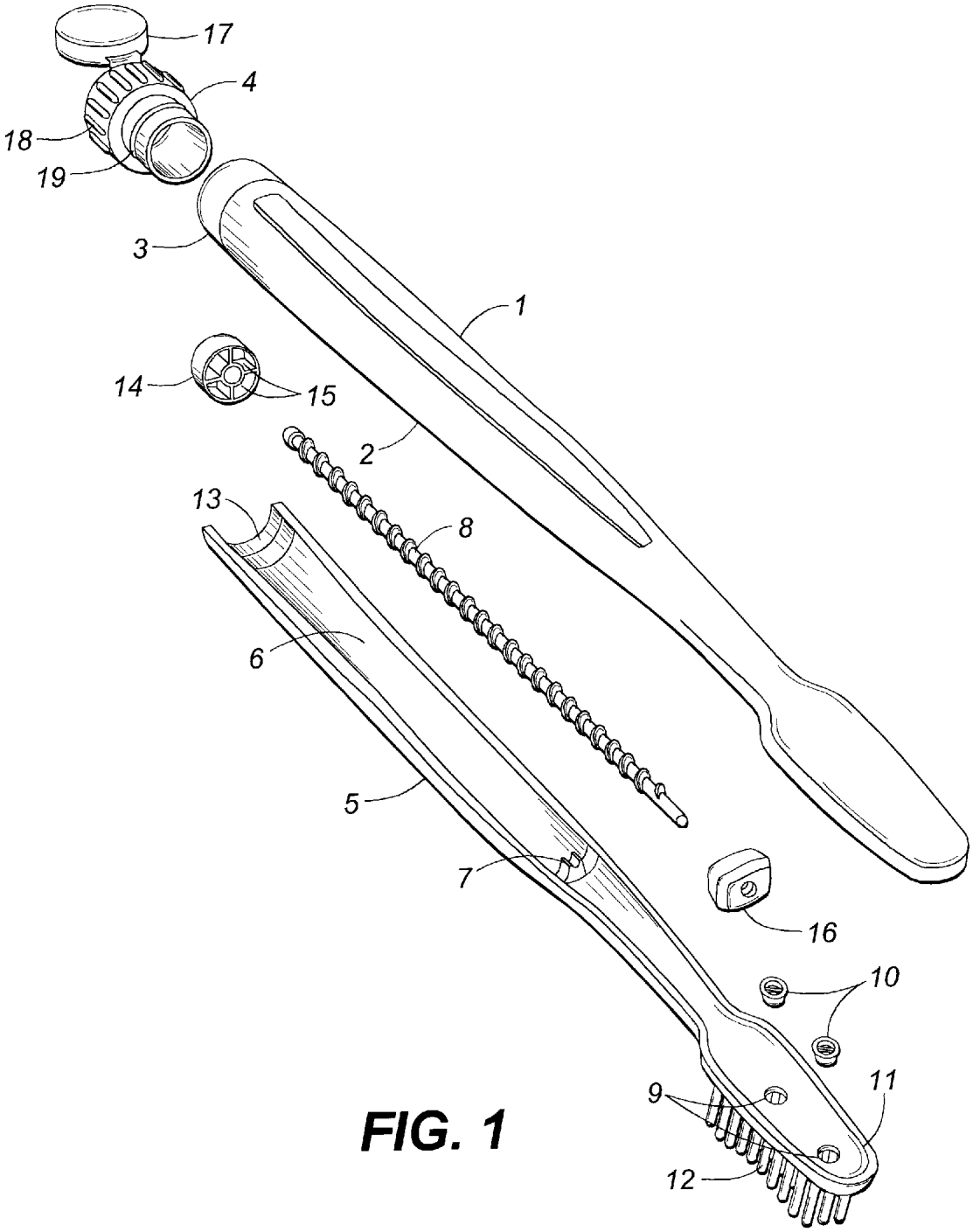
FIG. 1 is an exploded view of a refillable dentifrice dispensing toothbrush constructed in accordance with the preferred embodiment of the present invention.

Referring to FIG. 1, wherein there is illustrated an exploded isometric view of the present invention in the form of a toothbrush. The toothbrush comprises an upper body half 1 with an internal body cavity 2 for storage of toothpaste and internal threading 3 for acceptance of the refilling device 4. The lower body half 5 of the present invention comprises a hollow body cavity 6 of the unit with a bushing seat 7 for placement of a double helix cut drivescrew 8, sized openings 9 for placement of elastomer dispensing snap nipples 10 in the bristlehead 11, a plurality of bristles 12, and internal threading 13 for acceptance of the refilling device 4.

FIG. 1 also illustrates the bushing drive unit 14 with the refill orifices 15 which attaches to the double helix cut threaded drivescrew 8 allowing for two-way movement of the compression piston 16 from the compression movement forward to the refill position at the posterior end of the unit.

Also shown in FIG. 1 are the refilling device 4 with an attached hinged airtight seal snap cap 17 implemented to prevent contamination of the toothpaste refill and storage areas. In FIG. 1, the thumbscrew activator 18 is shown which rotates in either direction the assembly comprised of the bushing drive unit 14, double helix cut threaded drivescrew 8, and compression piston 16 which by forward movement compresses the toothpaste and dispenses same through the elastomer dispensing snap nipples 10 to the top of the plurality of bristles 12. FIG. 1 designates threading 19 at the placement end of the refilling device 4 to allow for an airtight assembly of the refilling device 4 to the upper body half 1 and lower body cavity base 6 after the two body halves are laser joined.

Figure 2:
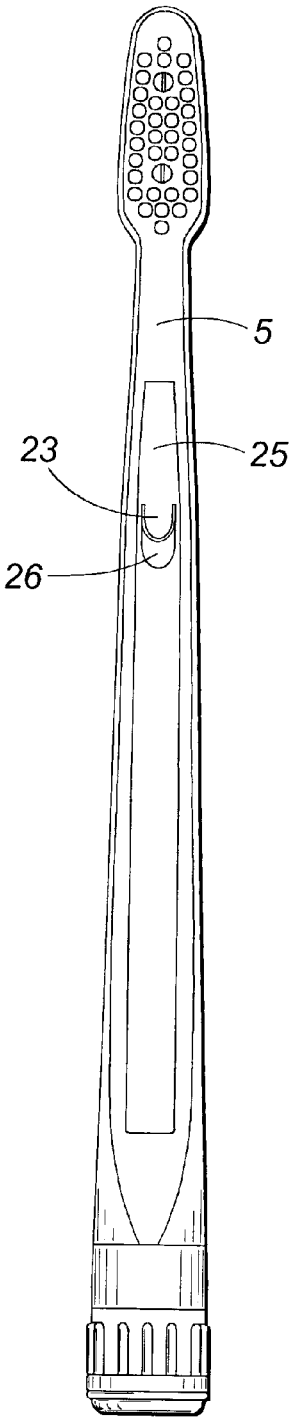
FIG. 2 is a bottom view of the toothbrush illustrated in FIG. 1.
Figure 3:
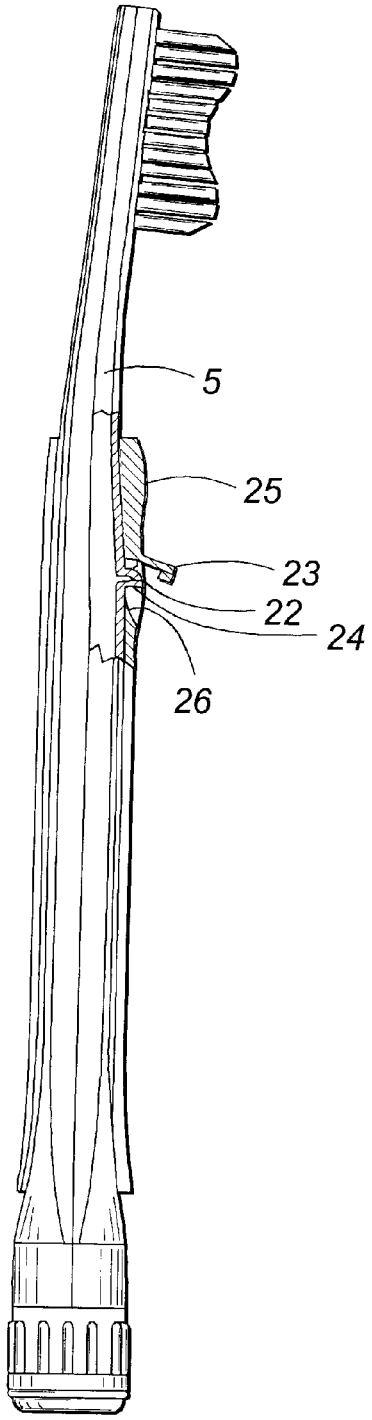
FIG. 3 is a side elevation view, shown partly in section, of the toothbrush illustrated in FIG. 1.

FIGS. 2 and 3 show the preferred embodiment having a pressure relief orifice 22 formed into lower body half 5 for purposes of releasing air pressure within the hollow body cavity 6 during the toothpaste refilling process. Orifice 22, which is preferably 0.010 inches in diameter, is in fluid communication with hollow body cavity/storage cavity 6. As best seen in FIG. 3, a portion of lower body half 5 extends outwardly about orifice 22 to form a nipple 24. Additionally, surfacing 25, comprised of a resilient material, is attached to the exterior surface of lower body half 5. This surfacing 25 is cut in one location so as to form a flap 23 adapted to fit over orifice 22 and nipple 24 when storage cavity 6 is not being filled with toothpaste. Also as best seen in FIG. 5, a portion of surfacing 25 proximate nipple 24 is recessed to form a flap seat 26 adapted to accommodate flap 23 when flap 23 is in a closed position.

Hinged flap 23 is opened when the compression piston 16 is retracted to the refilling position. As toothpaste is dispensed into the hollow body cavity 6 air pressure within the toothbrush is released through the orifice 22 allowing the toothbrush to be refilled easily and completely. At completion of the refilling process the user merely snaps the hinged flap 23 over the nipple 24, allowing for a hygienically sealed unit.

The object of the present invention is to provide an efficient toothpaste dispensing system contained within an acceptable design of a contemporary toothbrush that can be refilled with the user's choice of toothpaste, and maintains a hygienically clean interior environment.

FUNCTION

Operationally the toothbrush functions in the following manner:

The toothbrush is factory filed with a glycerin based toothpaste subsequent to the final assembly process in a clean room environment.

To dispense toothpaste to the bristle area, the user merely turns the thumbscrew activator one-half turn clockwise which rotates the bushing drive unit attached to the double helix cut drivescrew activating the drivescrew which subsequently moves the compression piston forward longitudinally along the interior walls of the internal toothpaste storage cavity compressing the toothpaste and dispensing toothpaste (for example, approximately 0.020 ounces) through the one-way dispensing snap nipple valves directly to the bristle area. As pressure is reduced internally by release of the thumbscrew activator the one-way dispensing snap nipple valves close to avoid contamination of the interior of the bristlehead.

The barrel of the toothbrush is, preferably, manufactured of a clear polymer while the interior components are of contrasting color allowing the user to determine visually the amount of toothpaste remaining after each application. As the supply of toothpaste is depleted, or at any time the user wishes to refill the unit, the user merely retracts the compression piston by rotating the thumbscrew activator counter-clockwise moving the compression piston in a reverse manner longitudinally along the interior walls of the toothpaste storage area to the posterior end of the toothbrush where the compression piston will abut the bushing drive unit of which the interior of the bushing drive unit has triangular openings to allow toothpaste to be injected into the toothpaste storage area around the compression piston as the interior of the toothpaste storage area has been enlarged at this point to allow passage of toothpaste to the area immediately to the front of the compression piston and throughout the toothpaste storage area.

Refilling is accomplished by unsnapping the hinged airtight seal snap cap and screwing into the immediate opening a standard tube of toothpaste which fits into the manufactured interior threading of the refilling device. Threading the tube of toothpaste fully into this threaded opening will bring the open tip of the tube of toothpaste directly in contact with the bushing drive unit with the refill orifices, thus eliminating any possible backflow and allowing toothpaste to be injected into the interior of the unit only. As the toothpaste is injected into the interior toothpaste storage area by applying pressure to the toothpaste tube, any air trapped in the interior toothpaste storage area is forced out of the unit through the dispensing snap nipple valves thus maintaining an air-free environment internally in the unit. As pressure is reduced on the toothpaste tube, the dispensing snap nipple valves close to eliminate outside contamination. As the user determines visually that the toothbrush is completely refilled, the user unscrews the tube of toothpaste from the refilling device and closes the hinged airtight seal snap cap. The toothbrush is again in a mode to operate as the design mandates.

I claim:

1. A paste dispensing toothbrush comprising:

a toothbrush body including a storage section having a wall assembly defining a storage cavity, and a head section having bristles mounted thereon and defining dispensing orifices therethrough in fluid communication between said storage cavity and the environment;

said body having a pressure relief orifice formed therein, said orifice fluidly communicating with said storage cavity;

said body extending outwardly about said pressure relief orifice to form a nipple;

a piston movably mounted within said cavity and movable along said storage cavity selectively toward and away from said head section;

valve elements releasably sealing said dispensing orifices;

surfacing attached to said toothbrush body; and a hinged flap formed from said surfacing adapted to fit over said nipple and said pressure relief orifice when said storage cavity is not being filled with toothpaste.

2. Toothbrush of claim 1, further comprising:

a threaded passage formed in said storage section in communication between said storage cavity and the environment, said passage being so sized as to mate in an airtight mariner with a threaded outlet of a paste refilling device.

3. Toothbrush of claim 1, wherein a portion of said surfacing proximate said nipple is recessed to form a flap seat adapted to accommodate said flap when said flap is in a closed position.

* * * * *